US006290536B1

(12) United States Patent
Hwang et al.

(10) Patent No.: US 6,290,536 B1
(45) Date of Patent: Sep. 18, 2001

(54) BLIND-MATE SNAP-IN CABLE CONNECTOR ASSEMBLY

(75) Inventors: Jenq-Yih Hwang, Irvine; Jeff Lung, Hsin-Chu, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/295,902

(22) Filed: Apr. 21, 1999

(51) Int. Cl.[7] ..... H01R 13/73
(52) U.S. Cl. ..... 439/553; 439/378; 439/954
(58) Field of Search ..... 439/553, 555, 439/248, 247, 157, 557, 552, 554, 378, 14, 680, 954

(56) References Cited

U.S. PATENT DOCUMENTS 4,812,133 * 3/1989 Fleak et al. ..... 439/248
5,199,900 * 4/1993 Hayes, Sr. ..... 439/557
5,263,871 * 11/1993 Sano ..... 439/157
5,514,000 * 5/1996 Krause et al. ..... 439/248
5,921,791 * 6/1999 Ono et al. ..... 439/157
6,022,246 * 2/2000 Ko ..... 439/680

* cited by examiner

*Primary Examiner*—Brian Sircus
*Assistant Examiner*—Phuong KT Dinh
(74) *Attorney, Agent, or Firm*—Wei Te Chung

(57) ABSTRACT

A blind-mate, snap-in cable connector assembly comprises a first connector mounted on a first supporting plate. The first connector includes a first housing defining a pair of cavities therethrough. A second connector is mated to the first connector. The second connector includes a second housing forming a pair of sleeves each received into the corresponding cavity when the connectors are assembled. Blind mating means formed between the first and second connectors includes a guiding rod formed on one of the first and second connectors and a receiving passage formed on another of the first and second connectors.

10 Claims, 5 Drawing Sheets

BLIND-MATE SNAP-IN CABLE CONNECTOR ASSEMBLY

FIELD OF THE INVENTION

The present invention relates to a cable connector, and more particularly to a blind-mate, snap-in cable connector assembly for facilitating quick installation.

DESCRIPTION OF PRIOR ART

Conventionally, electrical devices, such as floppy disk drive, hard disk drive, and CD-ROM, within an enclosure are electrically connected to a motherboard/controlling card by means of wire harnesses. However, the wire harnesses scattering around not only will bring a mess within the enclosure, but will also form obstacles during maintenance.

SUMMARY OF THE INVENTION

An objective of this invention is to provide a connector assembly for facilitating easy installation of an electrical device.

In order to achieve the objective set forth, a blind-mate, snap-in cable connector assembly comprises a first connector mounted on a first supporting plate. The first connector includes a first housing defining a pair of cavities therethrough. A second connector is mated to the first connector. The second connector includes a second housing forming a pair of sleeves each received into the corresponding cavity when the connectors are assembled. Blind mating means formed between the first and second connectors includes a guiding rod formed on one of the first and second connectors and a receiving passage formed on another of the first and second connectors.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
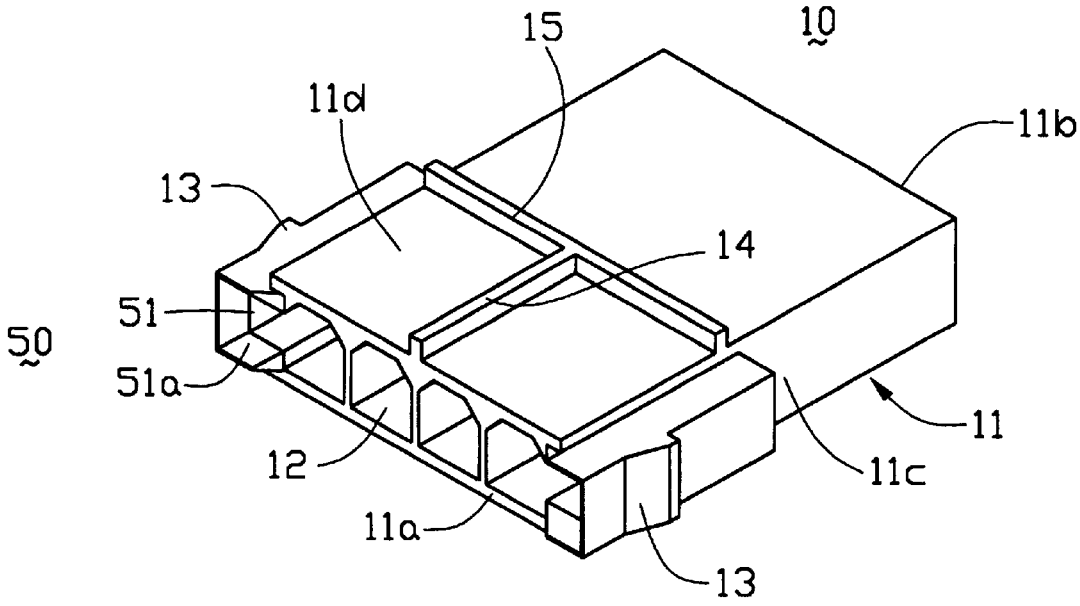
FIG. 1 is a perspective view of a plug connector in accordance with the present invention.
Figure 2:
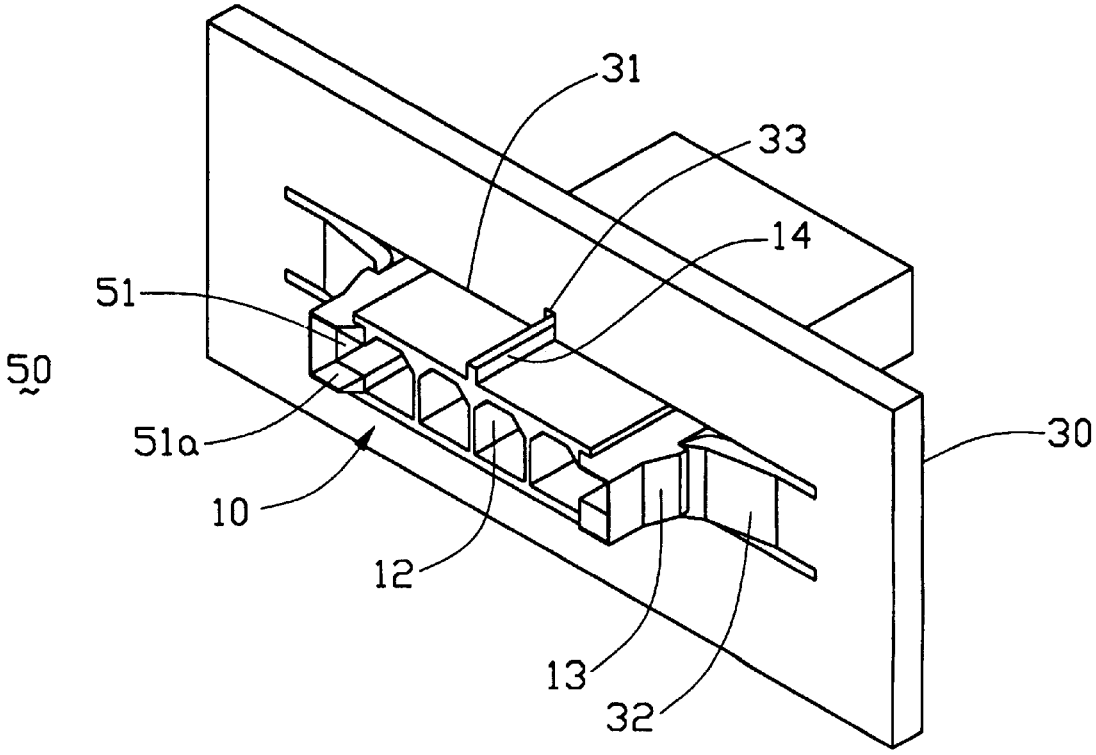
FIG. 2 is a perspective view of the plug connector assembled to a first supporting plate.
Figure 3:
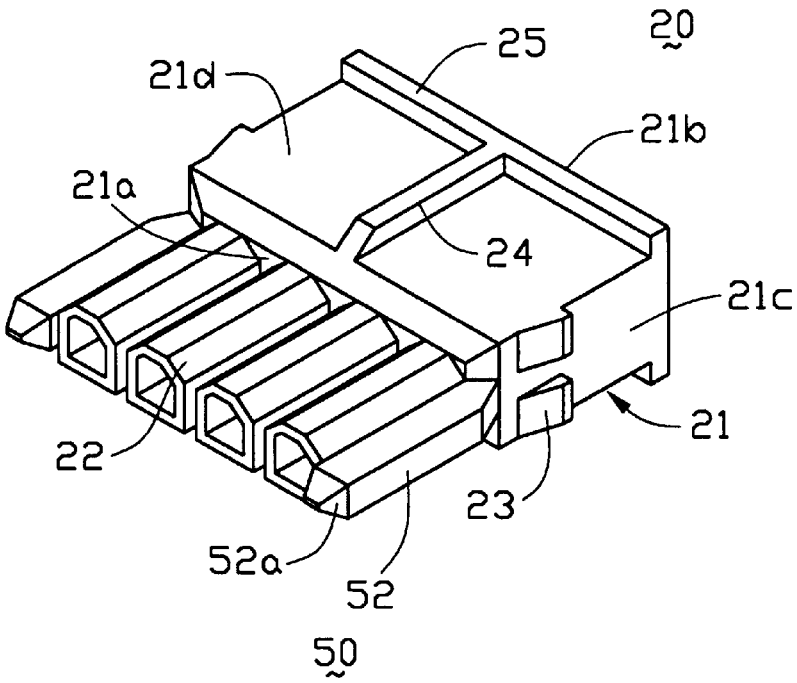
FIG. 3 is a perspective view of a receptacle connector in accordance with the present invention.
Figure 4:
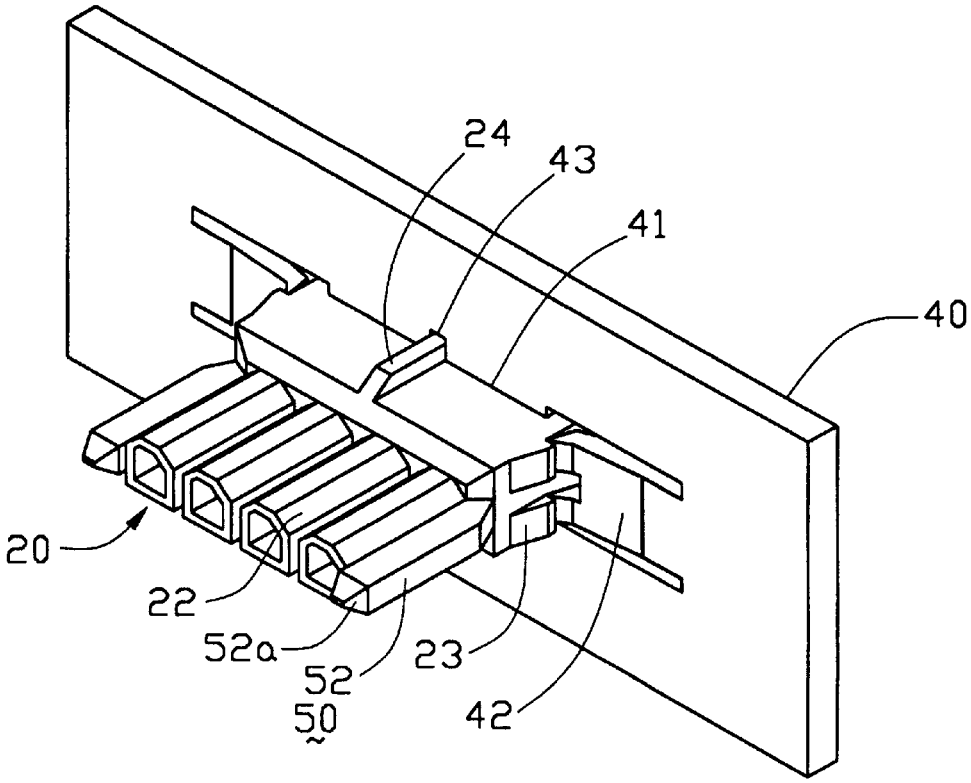
FIG. 4 is a perspective view of the receptacle connector assembled to a second supporting plate.
Figure 5:
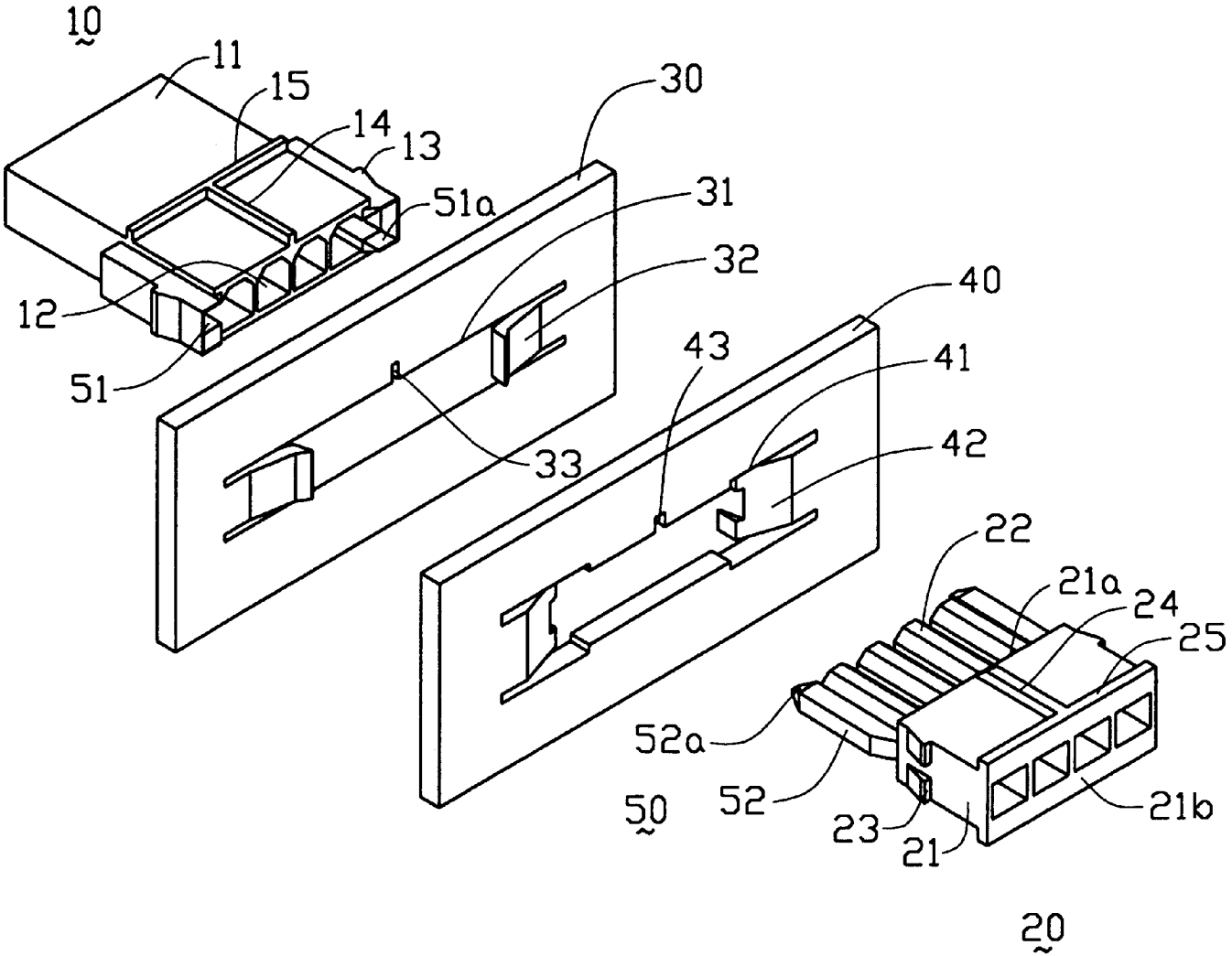
FIG. 5 is a perspective view of a connector assembly in accordance with the present invention.

Referring to FIGS. 1, 2, 3, 4 and 5, a blind-mate, snap-in cable connector assembly 1 comprises first and second connectors 10, 20.

The first connector 10 includes a first housing 11 having front and rear faces 11*a*, 11*b*. Four cavities 12 are defined between the front and rear faces 11*a*, 11*b*. The first housing

11 forms a pair of first retaining wedges 13 on transverse walls 11*c* thereof. Each cavity 12 receives a pin therein (not shown). The first housing 11 forms a first guiding ridge 14 on longitudinal wall 11*d* thereof. A first dam 15 perpendicular to the first ridge 14 is formed on the same longitudinal wall 11*d*.

The second connector 20 includes a second housing 21 having front and rear faces 21*a*, 21*b*. Four sleeves 22 extend from the front face 21*a*. The second housing 21 forms a pair of second retaining wedges 23 on transverse walls 21*c* thereof. Each sleeve 22 receives a receptacle therein corresponding the pin (not shown). The second housing 21 forms a second guiding ridge 24 on longitudinal wall 21*d* thereof. A second dam 25 perpendicular to the second ridge 23 is formed on the same longitudinal wall 21*d*.

The first and second connectors 10, 20 can be assembled to supporting plates 30, 40.

The first supporting plate 30 defines a first opening 31 for insertion of the first connector 10. A pair of first retaining tongues 32 extends from transverse ends of the first opening 31 for engagement with the corresponding first wedges 13. The first opening 31 further defines a first mating slot 33 for receiving the first guiding ridge 13 of the first connector 10.

The second supporting plate 40 defines a second opening 41 for extension of the second connector 20. A pair of second retaining tongues 42 extends from transverse ends of the second opening 41 for engagement with the corresponding second wedges 23. The second opening 41 further defines a second mating slot 43 for receiving the second guiding ridge 24 of the second connector 20.

Blind mating means 50 formed between the first and second connectors includes a receiving passage 51 formed on the first connector 10 and a guiding rod 52 formed on the second connectors 20. The receiving passage 51 defines a flared opening 51*a* and the guiding rod 52 includes a tapered tip 52*a* corresponding to the flared opening 51*a* for facilitating easy assembly therebetween.

Figure 6:
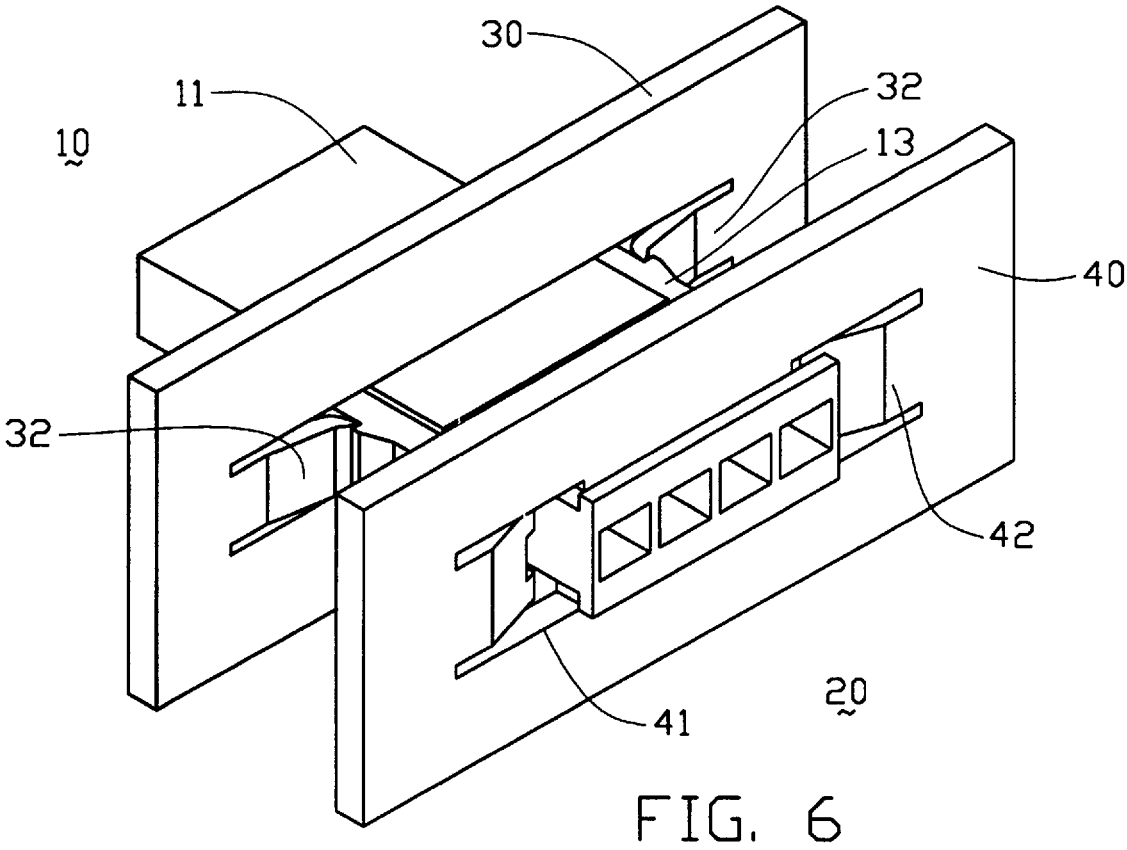
FIG. 6 is an assembled view of FIG. 5 viewed from bottom direction.
Figure 7:
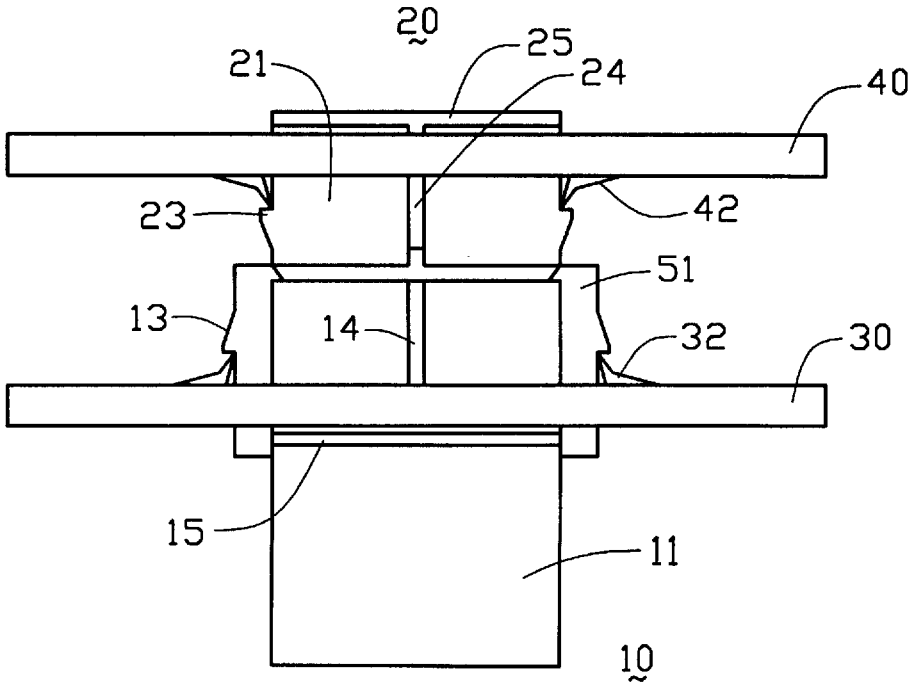
FIG. 7 is a top plan view of FIG. 6.
Figure 8:
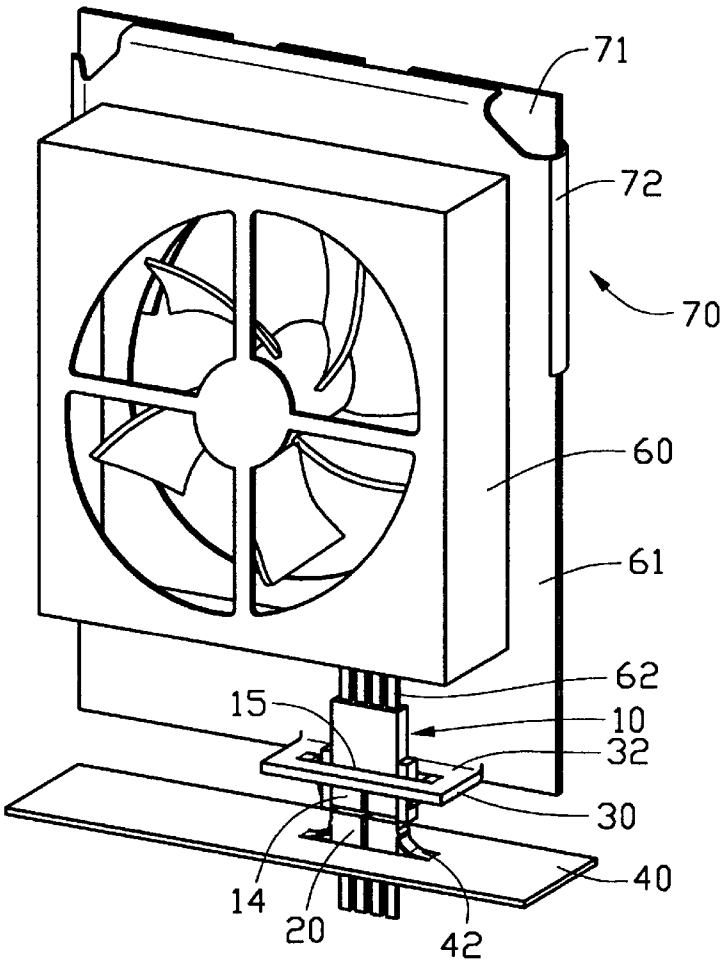
FIG. 8 is the connector assembly used between a cooling fan and a printed circuit board.

Referring to FIGS. 6, 7 and 8, according to one preferable embodiment of the present invention, the first supporting plate 30 is a wall of a casing 61 of a cooling fan 60. A wire harness 62 of the cooling fan 60 is terminated to the first connector 10. The second supporting plate 40 is embodied as a motherboard on which the second connector 20 is assembled. By this arrangement, the cooling fan 60 can be directly connected to the motherboard by the electrical engagement between the first and second connectors 10, 20 without the wire harness 62 scattered around. In order to facilitating easy assembly of the cooling fan 60, a pair of guiding slots 72 is formed on a wall 71 of an enclosure 70 of a computer and the second connector 20 can be arranged adjacent to the guiding slots thereby facilitating quick installation of the cooling fan 60 to the motherboard.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A blind-mate, snap-in cable connector assembly, comprising:

a first connector including a first housing having front and rear faces, at least a pair of cavities defined between said front and rear faces, said first housing forming at least a pair of first retaining wedges on transverse walls thereof, each cavity receiving a single pin therein;

a first supporting plate defining a first opening for insertion of said first connector, said first supporting plate forming first retaining tongues extending transversely into said first opening for engagement with corresponding first wedges;

a second connector mated to said first connector, including a second housing having front and rear faces, at least a pair of sleeves extending from said front face, at least a pair of second retaining wedges on transverse walls thereof, each sleeve receiving a receptacle for electrically engaging with said pin of said first connector when said first connector is assembled thereto;

a second supporting plate defining a second opening for insertion of said second connector and forming second retaining tongues extending traversely into said second opening for engagement with said corresponding second wedges; and blind mating means formed between said first and second connectors including a guiding rod formed on one of said first and second connectors.

2. The connector assembly as recited in claim 1, wherein said first housing forms at least a first dam on a longitudinal wall for abutting against said first supporting plate.

3. The connector assembly as recited in claim 1, wherein said second housing forms at lest a second dam on a longitudinal wall for abutting against said second supporting plate.

4. The connector assembly as recited in claim 1, wherein said first opening forming a first mating slot on a longitudinal side thereof.

5. The connector assembly as recited in claim 4, wherein said first housing forms a first guiding ridge mated with said first mating slot when said first connector is assembled to said first supporting plate.

6. The connector assembly as recited in claim 1, wherein said second opening forms a second mating slot on a longitudinal side thereof.

7. The connector assembly as recited in claim 6, wherein said second housing forms a second guiding ridge mated with said second mating slot when said second connector is assembled to said second supporting plate.

8. The connector assembly as recited in claim 1, wherein said guiding rod includes a tapered tip.

9. The connector assembly as recited in claim 8, wherein said receiving passage defines a flared opening corresponding to said tapered tip.

10. A blind-mate snap-in cable connector assembly comprising:

a first connector mounted on a first supporting plate;

a second connector mounted on a second supporting plate and mated with the first connector, said first connector including a housing with a pair of retaining wedges on two opposite transverse walls thereon, and with a guiding ridge and a dam on a longitudinal wall perpendicular to said transverse walls, said guiding ridge and said dam perpendicularly interconnecting to each other and together forming a T-shape thereof;

said first supporting plate defining an opening with a pair of retaining tongues extending from two opposite transverse ends of the opening and latchably engaged respectively with the corresponding retaining wedges for preventing backward movement of the first connector relative to the first supporting plate, and defining a mating slot in a longitudinal edge of and in communication with said opening; wherein a surface of said longitudinal wall is flush with the longitudinal edge of said opening, the guiding ridge is received within said mating slot, and the dam abuts against the supporting plate around said longitudinal edge of the opening for preventing forward movement of the first connector relative to the first supporting plate.

* * * * *